US011685173B2

(12) United States Patent
Veis et al.

(10) Patent No.: US 11,685,173 B2
(45) Date of Patent: Jun. 27, 2023

(54) PRINTING AND SELECTIVE DRYING

(71) Applicant: HP SCITEX LTD., Netanya (IL)

(72) Inventors: Alex Veis, Netanya (IL); Semion Birger, Netanya (IL)

(73) Assignee: HP SCITEX LTD., Netanya (IL)

( * ) Notice: Subject to any disclaimer, the term of this patent is extended or adjusted under 35 U.S.C. 154(b) by 209 days.

(21) Appl. No.: 17/031,192

(22) Filed: Sep. 24, 2020

(65) Prior Publication Data

US 2021/0094320 A1 Apr. 1, 2021

(30) Foreign Application Priority Data

Sep. 30, 2019 (EP) ..... 19200392

(51) Int. Cl.
*B41J 11/00* (2006.01)
*B41J 3/407* (2006.01)

(52) U.S. Cl.
CPC ..... *B41J 11/002* (2013.01); *B41J 3/4078* (2013.01); *B41J 11/007* (2013.01)

(58) Field of Classification Search
CPC .. B41J 3/4078; B41J 11/0015; B41J 11/0021; B41J 11/00214; D06P 5/30; B41M 7/0018; B41M 5/0017; B41M 5/0011; C09D 11/54
See application file for complete search history.

(56) References Cited

U.S. PATENT DOCUMENTS

| | | | | |
|---|---|---|---|---|
| 7,134,749 | B2 | 11/2006 | Ben-Zur | |
| 8,784,508 | B2 | 7/2014 | Ellis | |
| 10,252,548 | B2 | 4/2019 | Paul | |
| 10,882,337 | B1 * | 1/2021 | Condello | B41J 11/00212 |
| 2001/0052312 | A1 * | 12/2001 | Codos | D05B 11/00 112/475.08 |
| 2003/0043246 | A1 * | 3/2003 | Codos | B41J 2/01 347/102 |
| 2005/0190248 | A1 * | 9/2005 | Konno | B41J 11/0015 347/42 |
| 2006/0162586 | A1 | 7/2006 | Fresener | |
| 2010/0321452 | A1 | 12/2010 | Lee | |
| 2015/0097906 | A1 * | 4/2015 | Beier | B41M 5/0017 347/103 |
| 2017/0271843 | A1 * | 9/2017 | Batchelder | B33Y 30/00 |

(Continued)

FOREIGN PATENT DOCUMENTS

| | | | |
|---|---|---|---|
| CN | 100354134 | C | 12/2007 |
| CN | 103261511 | B1 | 4/2015 |

*Primary Examiner* — John Zimmermann

(57) ABSTRACT

In an example of the disclosure, a print job is received. The print job includes an image to be printed upon a substrate utilizing printheads. The print job is analyzed to determine a set of imaged segments, a set of image-adjacent segments, and a set of remote segments. The print job is printed upon the substrate utilizing a first set of printheads. A cooling liquid is applied to the set of image-adjacent segments of the printed print job utilizing a second set of printheads downstream from the first set of printheads. The printed job is exposed to an array of controllable illumination elements. The array of illumination elements is controlled to apply a drying illumination to the imaged segments and the image-adjacent segments of the printed print job, without providing the drying illumination to the remote segments.

18 Claims, 5 Drawing Sheets

(56) References Cited

U.S. PATENT DOCUMENTS

| | | | | |
|---|---|---|---|---|
| 2018/0105979 | A1 | 4/2018 | Matsumoto | |
| 2018/0230647 | A1 | 8/2018 | Petton | |
| 2018/0333971 | A1* | 11/2018 | Sasaki | B41J 11/00222 |
| 2019/0009604 | A1 | 1/2019 | Hachmann | |
| 2019/0092045 | A1 | 3/2019 | Hofstra | |
| 2019/0322881 | A1* | 10/2019 | Chopra | C09D 11/12 |

* cited by examiner

PRINTING AND SELECTIVE DRYING

BACKGROUND

A print system may apply print agents to a substrate to produce an image on the substrate. A particular example of a print system is an inkjet print system (e.g., thermal inkjet or piezo inkjet) for printing directly upon a substrate.

DRAWINGS

DETAILED DESCRIPTION

Figure 1:
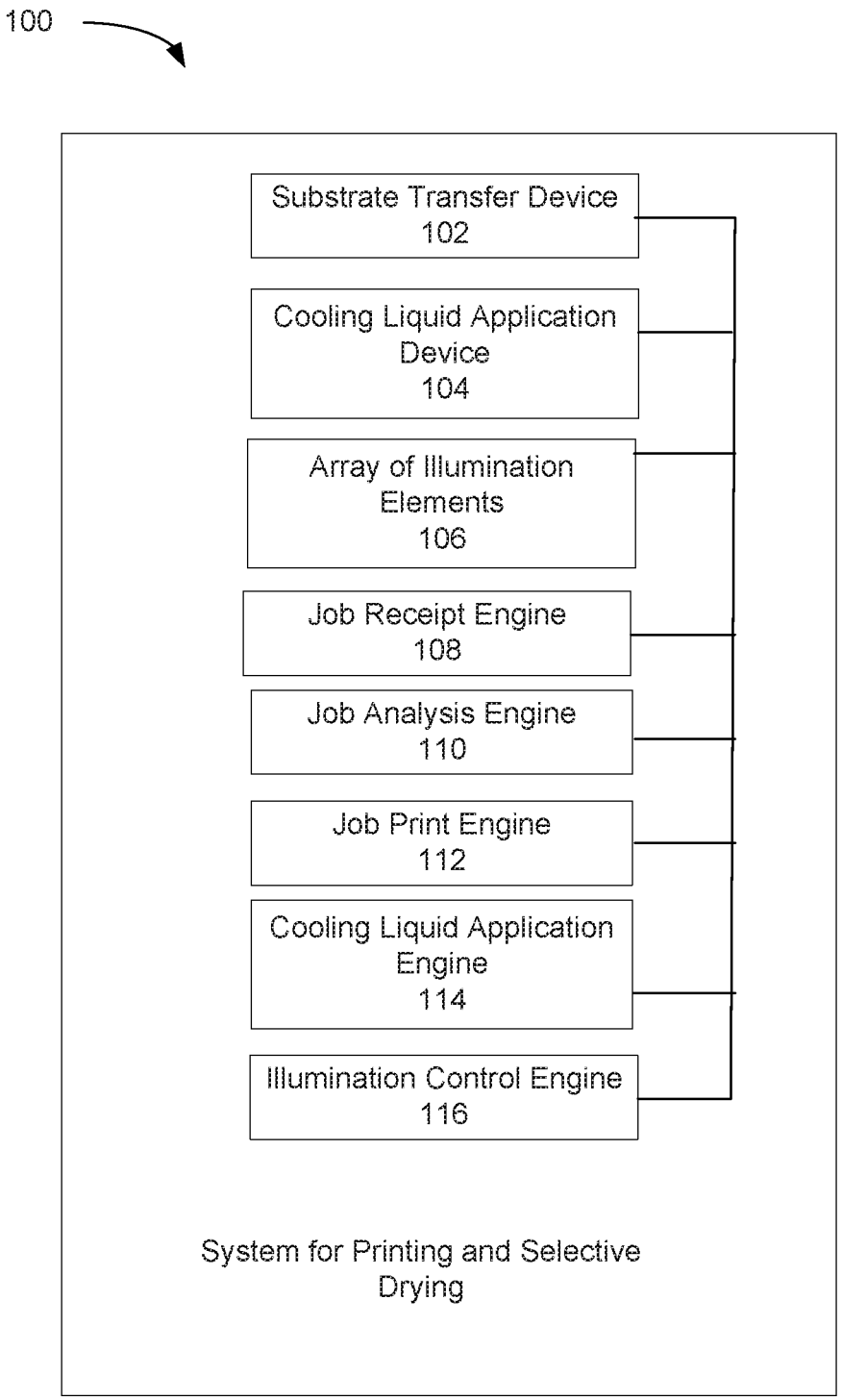
FIG. 1 illustrates an example of a system for printing and selective drying.

Digital printing is a growing alternative to analog printing methods (e.g., screen printing) for printing upon textiles. Inkjet printing directly upon a textile substrate, for example, enables a high-quality printing upon the textile substrate without long set up times and job-change times associated with many analog printing systems.

However, drying of textile substrates after digital printing has been challenging. In an example, an image may be printed upon a black or other darkly colored textile by an inkjet printer (e.g., using a color ink (e.g., a CMY or K ink), or using a color ink printed over a layer of white ink printed where the CMY or K image is to be printed). In this example drying using light energy emission sources such as UV, visible light or IR has been difficult as the dark non-printed areas absorb radiation, causing the temperature of these areas to rise quickly during the drying. Synthetic fabrics such as polyester can melt at temperature above 250° C. As a result, often the dark non-printed areas will burn from the drying while the printed areas are protected to a degree by the applied inks. Using hot air and other non-radiation methods are alternatives to try to avoid fabric burning, but such methods typically result in drying systems that with a larger footprint and less efficiency than light-energy drying systems.

To address these issues, various examples described in more detail below provide a system and a method that enables printing and selective drying of a substrate, e.g., a textile substrate. In an example of the disclosure, a print job that includes an image to be printed upon a substrate utilizing printheads is analyzed. The print job analysis is to determine a set of imaged segments of the print job, a set of image-adjacent segments of the print job, and a set of remote segments of the print job. The print job is printed utilizing a first set of printheads. A cooling liquid is applied to the set of image-adjacent segments of the printed print job utilizing a second set of printheads downstream from the first set of printheads. The printed print job is exposed to an array of controllable illumination elements. The array of illumination elements is to apply a drying illumination to the imaged segments and the image-adjacent segments of the printed print job, without providing the drying illumination to the remote segments. In examples, the drying illumination is controlled by determining and applying an exposure time for the illumination elements utilized in drying the image-adjacent segments of the substrate.

In this manner the disclosed system and method enable illumination drying of textile substrates that were printed upon with an inkjet printer, without burning areas where ink was not applied to the substrate. Users will appreciate the high-quality printing and efficient drying made possible by the disclosure. Customer satisfaction with direct-upon-textile inkjet printing will increase, such that installations and utilization of printers that utilize the disclosed system and method will be enhanced.

FIGS. 1-4 depict examples of physical and logical components for implementing various examples. In FIG. 1 various components are identified as engines 108-116. In describing engines 108-116 focus is on each engine's designated function. However, the term engine, as used herein, refers generally to hardware and/or programming to perform a designated function. As is illustrated later with respect to FIG. 2, the hardware of each engine, for example, may include one or both of a processor and a memory, while the programming may be code stored on that memory and executable by the processor to perform the designated function.

FIG. 1 illustrates an example of a system 100 for printing and selective drying of a substrate. In this example, system 100 includes a substrate transfer device 102, a cooling liquid application device 104, an array of illumination elements 106, a job receipt engine 108, a job analysis engine 110, a job print engine 112, a cooling liquid application engine 114, and an illumination control engine 116. In performing their functions, engines 108-116 may access a data repository, e.g., a memory accessible to system 100 that can be used to store and retrieve data.

In the example of FIG. 1, system 100 includes a substrate transfer device 102 for driving a substrate sheet. As used herein a "substrate transfer device' refers generally to any combination of hardware and/or programming to direct a substrate, e.g., a textile substrate, along a substrate path. In an example, substrate transfer device 102 may include a conveyer belt driven by rotatable rollers, wherein the rollers are caused to rotate by a drive mechanism. In examples the drive mechanism for substrate transfer device 102 may include one or all of a set of gears, a set of pulleys, and/or a transmission.

As used herein a "substrate" refers generally to any media or surface upon which a print agent is to be applied to form a printed image. In examples, a substrate may be a web substrate, e.g., wherein a continuous web is fed from a feeding roller, through or past a print agent application component, and then collected at a collection roller. In other examples, a substrate may be in a sheet or page form that is to pass through or by a print agent application component. In examples, a substrate may be or include, but is not limited to, a canvas, paper, photo paper, synthetic, cardstock, cardboard, and/or corrugated material. In particular examples, a substrate may be a textile substrate. As used herein a "textile" and "fabric" are used synonymously and refer generally to a material that includes a cloth or other material produced by a weaving, knitting, or felting of organic and/or textile fibers.

Continuing with the example of FIG. 1, system 100 includes a cooling liquid application device 104. As used herein, a "cooling liquid" refers generally to any liquid that is utilized reduce temperature of, or transfer heat from, an object, e.g. a printed upon substrate. In an example, cooling liquid application device 104 may be or include a set of printheads for jetting a cooling liquid upon a printed upon substrate. As used herein, a "printhead" refers generally to a mechanism for ejection of a liquid. In examples the ejected liquid is an ink. In other examples the ejected liquid is a liquid other than an ink. Examples of printheads are drop on demand printheads, such as piezoelectric printheads and thermo resistive printheads. Some printheads may be part of a cartridge which also stores the liquid to be dispensed. Other printheads are standalone and are supplied with liquid by an off-axis liquid supply. As used herein, "print agent" refers generally to any substance that can be applied upon a substrate by a printer during a printing operation, including but not limited to inks, primers and overcoat materials (such as a varnish), water, and solvents other than water. As used herein an "ink" refers generally to a liquid that is to be applied to a substrate during a printing operation to form an image upon the substrate. As used herein, a "printer" refers generally to any electronic device that is to print an image upon a substrate. As used herein, "printer" includes any multifunction electronic device that performs a function such as scanning and/or copying in addition to printing. In a particular example, a printer may be a liquid inkjet printer.

In examples, the cooling liquid to be applied to the set of image-adjacent segments is a print agent liquid that is utilized in other printing operations at the printer. In examples, the cooling liquid may be a transparent or substantially transparent cooling liquid. In particular examples, the cooling liquid may a transparent or substantially transparent liquid that is or includes an ink, a primer, a fixer, an overcoat liquid, water, and/or a solvent other than water.

Continuing with the example of FIG. 1, system 100 includes an array of controllable illumination elements 106. As used herein, an "illumination element" refers generally to any light source. In examples, an illumination element may be an infrared ("IR") illumination element such as a diode, lamp, or laser. In an example array of illumination elements 106 may be an array of LEDs that produce a drying illumination that includes UV light. In an example array of illumination elements 106 may be an array of LEDs to produce a drying illumination including UV light between 356 nm and 395 nm.

Continuing with the example of FIG. 1, system 100 includes job receipt engine 108. Job receipt engine 108 represents generally any combination of hardware and programming that is to receive a print job including an image to be printed upon the textile substrate. As used herein, a "print job" refers generally to content, a plot and/or instructions as to formatting and presentation of the content or plot sent to a printer for printing. In examples, a print job may be stored in a programming language and/or a numerical form so that the job can be stored and used in computing devices, servers, printers and other machines capable of performing calculations and manipulating data. In examples the content or plot may contain an image portion and a portion without an image (e.g., a blank portion). As used herein, an "image" refers generally to a rendering of an object, scene, person, or abstraction such text or a geometric shape.

Continuing with the example of FIG. 1, system 100 includes job analysis engine 110. Job analysis engine 110 represents generally any combination of hardware and programming that is to analyze the received print to job to identify or determine a set of imaged segments, a set of image-adjacent segments, and a set of remote segments. As used herein, a "segment" refers generally to an identified portion of the plot or print job when printed. An "imaged segment" refers generally to a segment wherein is to be applied by printheads to a threshold liquid level to create an image to be printed from the print job. As used herein, an "image-adjacent segment" refers generally to a segment that is not an imaged segment and has a distance from a nearest imaged segment that is less than a predetermined threshold distance. As used herein, a "remote segment" refers generally to a segment that is not an imaged segment and is not an image-adjacent segment. In other words, in an example a remote segment does not include ink at a threshold level and is not a segment that is within the predetermined threshold distance an imaged segment. In certain examples, ink may be applied to an image-adjacent segment or a set of image-adjacent segments at a level below the threshold level to create an image.

Job analysis engine 110 is additionally to analyze the print job to determine an amount of cooling liquid to be applied to the image-adjacent segments of the print job. In an example, job analysis engine 110 is determine an amount of cooling liquid to be applied to each of the image-adjacent segments based upon known or recorded absorption properties of the substrate. In a particular example, job analysis engine may access a database or look-up table with substrate absorption properties as it determines the cooling liquid application amounts.

Continuing with the example of FIG. 1, system 100 includes job print engine 112. Job print engine 112 represents generally any combination of hardware and programming that is to cause a first set of printheads at the printer to print the received print job upon a substrate. In examples, the first set of printheads may include thermo resistive printheads or piezoelectric printheads.

Continuing with the example of FIG. 1, system 100 includes cooling liquid application engine 114. Cooling liquid application engine 114 represents generally any combination of hardware and programming that is to control a second set of printheads, downstream from the first set of printheads, to selectively apply the cooling liquid to the image-adjacent segments of a printed print job. The image adjacent segments were determined by job analysis engine 110.

Continuing with the example of FIG. 1, system 100 includes illumination control engine 116. Illumination control engine 116 represents generally any combination of hardware and programming that is to cause the substrate transfer device to move the substrate to be exposed to the array of controllable illumination elements. Illumination engine 116 is to control the array of illumination elements to apply a drying illumination to the imaged segments and the image-adjacent segments of the printed print job, without providing the drying illumination to the remote segments.

In a particular example, illumination engine 116 is to correlate the determined imaged segments, image-adjacent segments, and remote segments of the print job with subdivisions of the array of controllable illumination elements. In this particular example, job analysis engine 110 is to determine an exposure time for each of the illumination elements of the array that is to be utilized for drying the substrate, and to control the drying illumination according to the determined exposure time.

In a particular example, the array of illumination elements includes a first set of illumination elements that correlates with the imaged segments and with the image-adjacent segments of the print job. In this particular example the array of illumination elements includes a second set of illumination elements that correlates with the remote segments of the print job. In this particular example, illumination control engine 116 is to activate the first set of elements to accomplish selective drying of the printed print job, while not activating the second set of illumination elements that correlate with the remote segments of the job. In this manner the disclosed system 100 avoids burning the image-adjacent segments and remote segments of the print job that might otherwise be burned by a conventional illumination/light-drying system.

In certain examples, illumination control engine 116 controlling the array of illumination elements to apply a drying illumination includes a determining an exposure time for each of the illumination elements that is to be utilized for drying the printed upon substrate. For instance, illumination control engine 116 may determine an exposure time for each of the illumination elements that correlate with drying the imaged segments and the image-adjacent segments of the print job as it to be printed on the substrate. In this certain example, illumination control engine 116 is to control the drying illumination according to the determined exposure times.

In the foregoing discussion of FIG. 1, engines 108-116 were described as combinations of hardware and programming. Engines 108-116 may be implemented in a number of fashions. Looking at FIG. 2 the programming may be processor executable instructions stored on a tangible memory resource 230 and the hardware may include a processing resource 240 for executing those instructions. Thus, memory resource 230 can be said to store program instructions that when executed by processing resource 240 implement system 100 of FIG. 1.

Memory resource 230 represents generally any number of memory components capable of storing instructions that can be executed by processing resource 240. Memory resource 230 is non-transitory in the sense that it does not encompass a transitory signal but instead is made up of a memory component or memory components to store the relevant instructions. Memory resource 230 may be implemented in a single device or distributed across devices. Likewise, processing resource 240 represents any number of processors capable of executing instructions stored by memory resource 230. Processing resource 240 may be integrated in a single device or distributed across devices. Further, memory resource 230 may be fully or partially integrated in the same device as processing resource 240, or it may be separate but accessible to that device and processing resource 240.

In one example, the program instructions can be part of an installation package that when installed can be executed by processing resource 240 to implement system 100. In this case, memory resource 230 may be a portable medium such as a CD, DVD, or flash drive or a memory maintained by a server from which the installation package can be downloaded and installed. In another example, the program instructions may be part of an application or applications already installed. Here, memory resource 230 can include integrated memory such as a hard drive, solid state drive, or the like.

Figure 2:
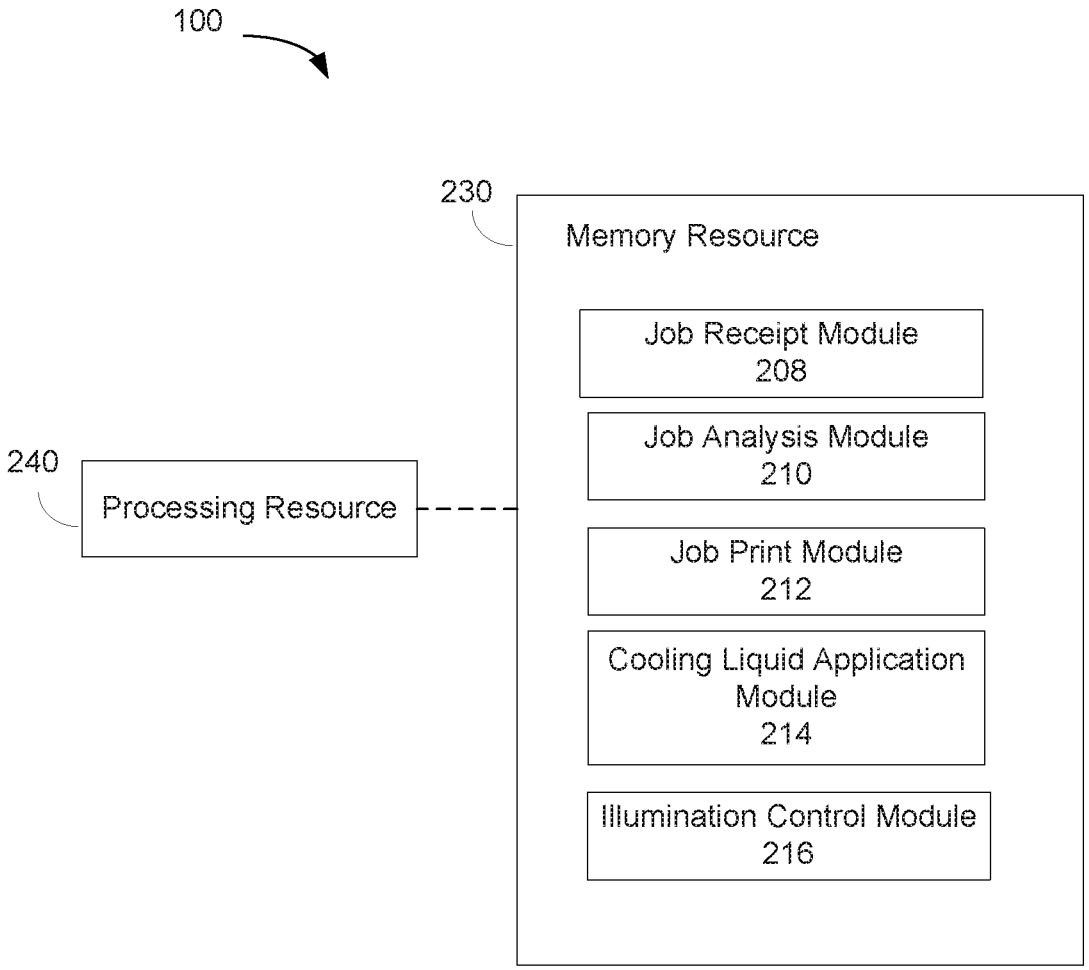
FIG. 2 is a block diagram depicting a memory resource and a processing resource to implement an example of a method for printing and selective drying.

In FIG. 2, the executable program instructions stored in memory resource 230 are depicted as job receipt module 208, job analysis module 210, job print module 212, cooling liquid application module 214, and illumination control module 216. Job receipt module 208 represents program instructions that when executed by processing resource 240 may perform any of the functionalities described above in relation to job receipt engine 108 of FIG. 1. Job analysis module 210 represents program instructions that when executed by processing resource 240 may perform any of the functionalities described above in relation to job analysis engine 110 of FIG. 1. Job print module 212 represents program instructions that when executed by processing resource 240 may perform any of the functionalities described above in relation to job print engine 112 of FIG. 1. Cooling liquid application module 214 represents program instructions that when executed by processing resource 240 may perform any of the functionalities described above in relation to cooling liquid application engine 114 of FIG. 1. Illumination control module 216 represents program instructions that when executed by processing resource 240 may perform any of the functionalities described above in relation to illumination control engine 116 of FIG. 1.

Figure 3A:
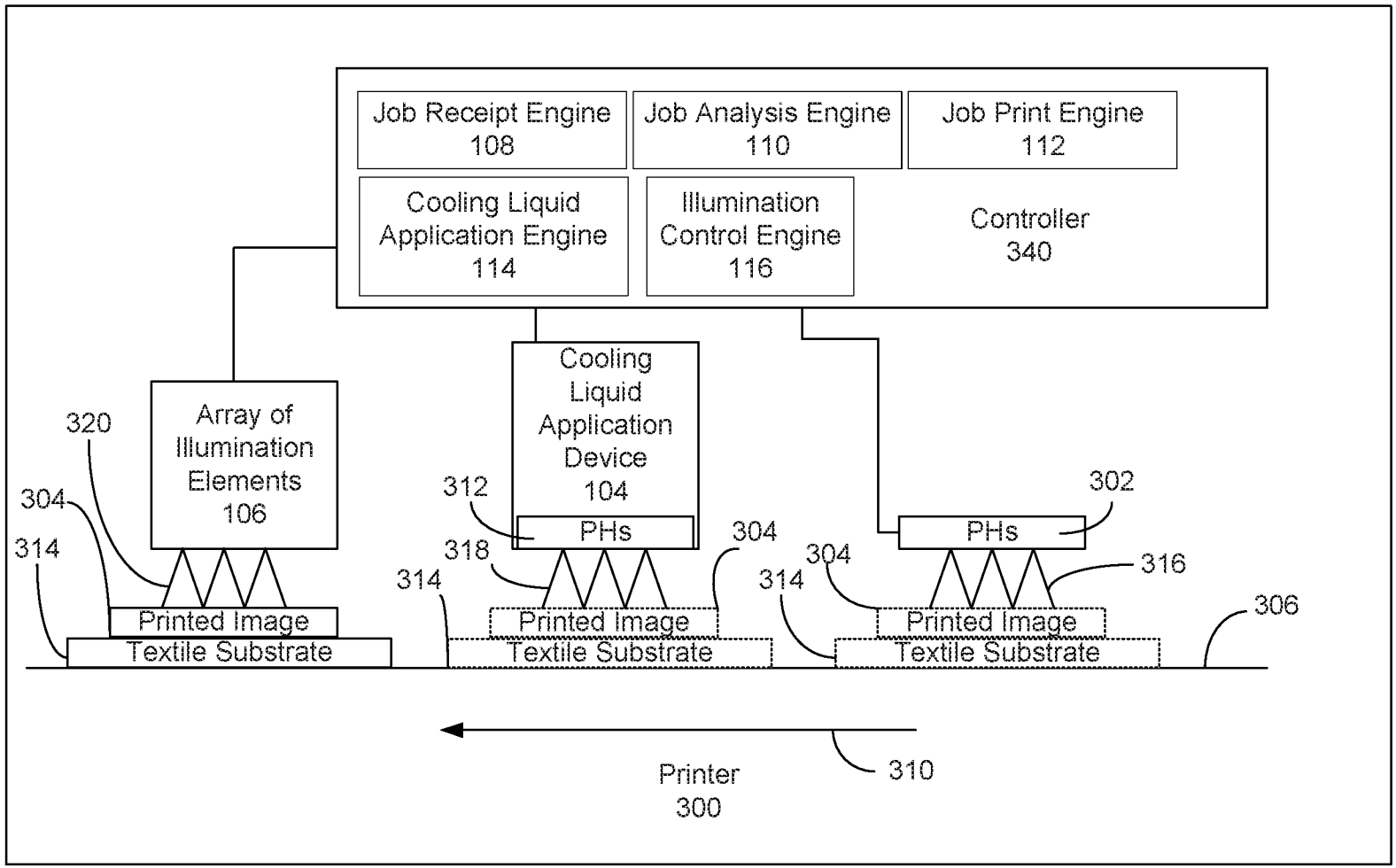
FIGS. 3A and 3B illustrate an example of an inkjet printer including a system for printing upon and selectively drying a textile substrate with an array of controllable illumination elements.
Figure 3B:
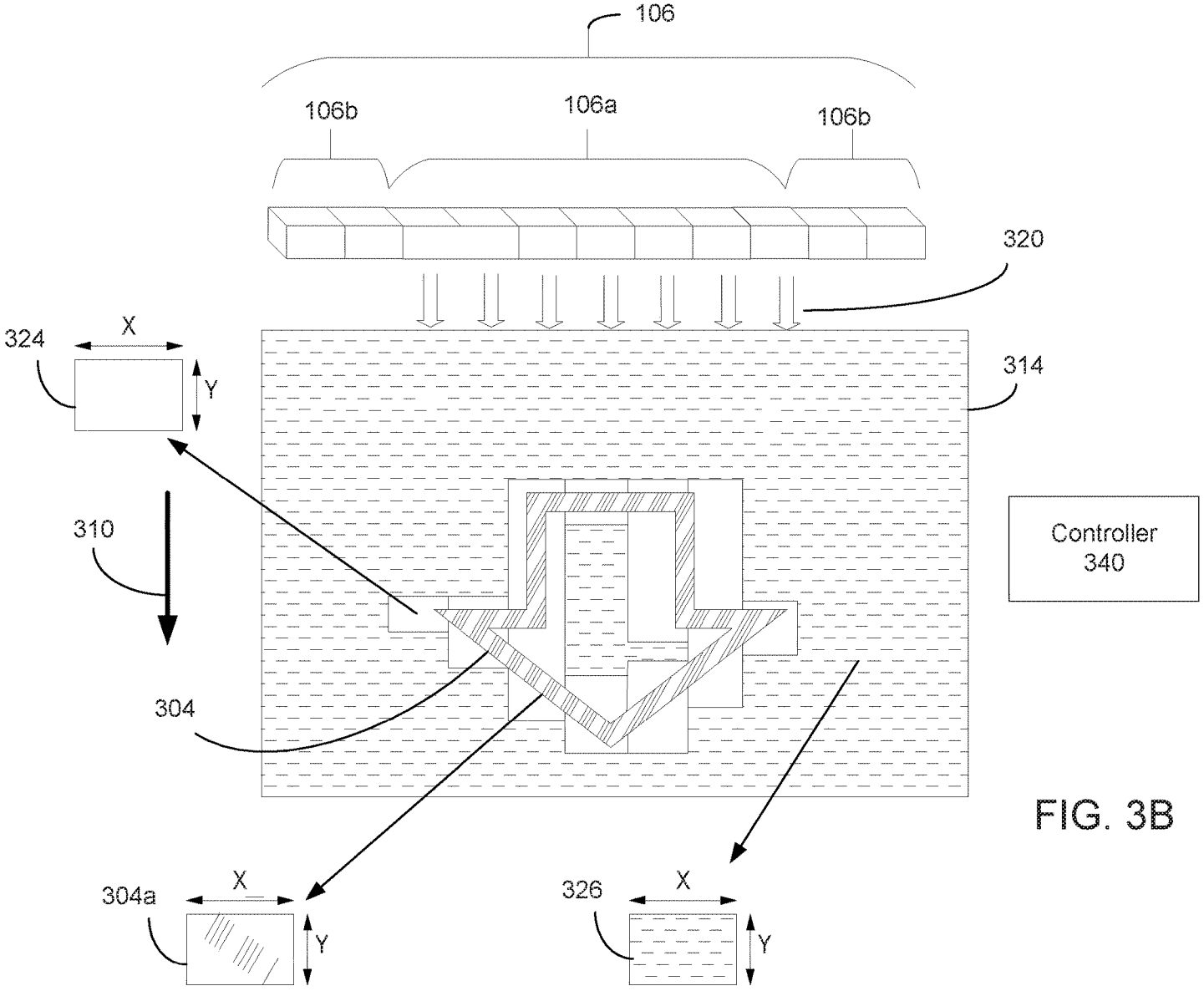

FIGS. 3A and 3B together illustrate an example of an inkjet printer 300 including a system for selectively drying of a textile substrate with an array of controllable illumination elements. Inkjet printer 300 includes a first set printheads 302 for forming an image by applying ink 316 upon a textile substrate 314. In the example of FIGS. 3A and 3B, the image 304 is a representation of an arrow shape, the arrow shape to be printed upon a textile substrate 314. Printer 300 includes a conveyor 306 or other substrate transfer device for moving the textile substrate in a substrate movement direction 310.

Printer 300 includes a cooling liquid application device 104 with a second set of printheads 312 for selectively applying a cooling liquid 318. In this example, cooling liquid 318 to be applied to the set of image-adjacent segments is a transparent or substantially transparent cooling liquid that is utilized in other printing operations at the printer (e.g. a transparent or substantially transparent ink, a primer, a fixer, or an overcoat liquid). In other examples, the cooling liquid may be water, or a solvent other than water.

In the example of FIGS. 3A and 3B, printer 300 includes an array of LED illumination elements 106 for emitting a drying illumination 320 with wavelength between 356 nm and 395 nm.

Controller 340 represents generally any combination of hardware and programming that is to control part, or all, of inkjet printer 300 components and print processes. In this example, the controller 340 includes job receipt engine 108, job analysis engine 110, job print engine 112, cooling liquid application engine 114, and illumination control engine 116, and can control printing upon and selective drying of a textile substrate 314.

Continuing with the example of FIGS. 3A and 3B, controller 340 is to receive a print job including the image 304 (in this example an arrow shape) to be printed upon the textile substrate 314. In this example the textile substrate 314 is a dark, e.g., black fabric that would be susceptible to burning in areas near the borders of image 304 using conventional drying techniques.

Controller 340 is to analyze the received print to job to determine a set of imaged segments 304*a* of the print job's image 304, a set of image-adjacent segments 324 of the print job's image 304, and a set of remote segments 326 of the print job's image 304. In this example imaged segments 304*a* are illustrated at FIG. 3B with a diagonal hashed pattern, image-adjacent segments 324 are illustrated with a blank, no-hash pattern, and remote segments 326 are indicates with a horizontal hash pattern.

Controller 340 is to determine an amount of cooling liquid 318 to be applied to each of the image-adjacent segments 324 of the print job. Job analysis engine may access a database or look-up table with substrate absorption properties as it determines the cooling liquid application amounts.

Continuing with the example of FIGS. 3A and 3B, controller 340 is to cause the first set of printheads 302 to print the print job upon the textile substrate 314. Controller 340 is to control the second set of printheads 312 to selectively apply the cooling liquid 318 to the image-adjacent segments 324 of the printed print job.

Controller 340 is to cause the conveyor substrate transfer device 306 to move the textile substrate 314 to be exposed to the array of controllable illumination elements 106. Controller 340 is to control the array of illumination elements 106 to apply a drying illumination to the imaged segments 304*a* and the image-adjacent segments 324 of the printed print job, without providing the drying illumination to the remote segments 326.

In the example of FIGS. 3A and 3B, controller 340 is to correlate the determined imaged segments 304*a*, image-adjacent segments 324, and remote segments 326 of the print job with subdivisions of the array of controllable illumination elements 106. In this example, controller 340 is to determine an exposure time for each of the illumination elements 106*a* (FIG. 3B) of the array that is to be utilized for drying the textile substrate 314, and to control the drying illumination according to the determined exposure time.

In this example, the array of illumination elements 106 includes a first set of illumination elements 106*a* (FIG. 3B) that correlates with the imaged segments 304*a* and with the image-adjacent segments 324 of the print job. In this example the array 106 of illumination elements includes a second set of illumination elements 106*b* (FIG. 3B) that correlates with the remote segments 326 of the print job. In this example, controller 340 is to activate the first set of illumination elements 106*a* to accomplish selective drying of the printed print job, while not activating the second set of illumination elements 106*b* that correlate with the remote segments 326 of the job. In this manner burning of the image-adjacent segments 324 and the remote segments 326 of the print job can be avoided.

In this example, controller 340 determines an exposure time for each of the illumination elements 106*a* that is to be utilized for drying the printed upon substrate. For instance, controller 340 may determine an exposure time for each of the illumination elements 106*a* that correlate with drying the imaged segments 304*a* and the image-adjacent segments 324 of the print job as it to be printed on the substrate 314. In this example, controller 340 is to control the drying illumination 320 according to the determined exposure times.

Figure 4:
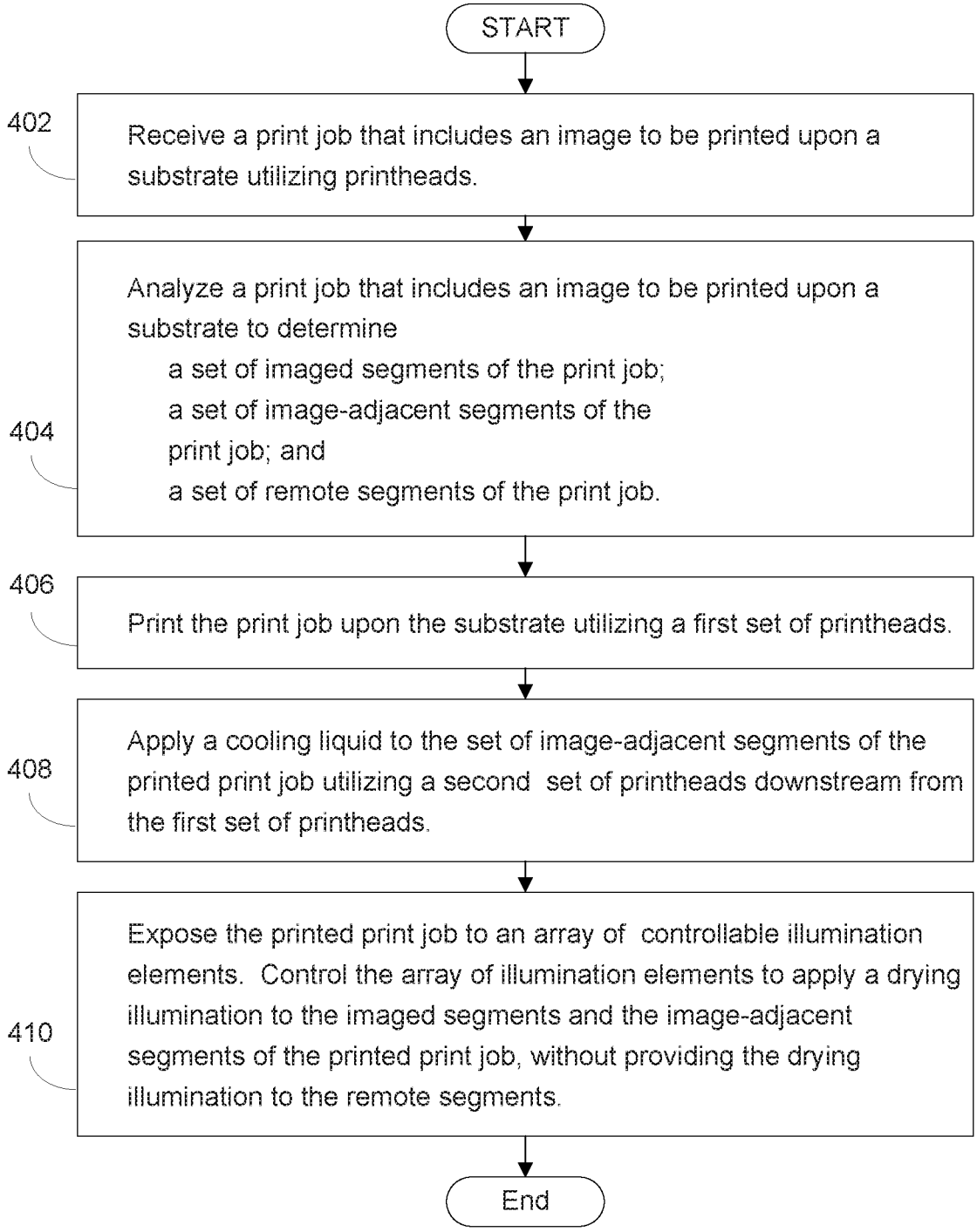
FIG. 4 is a flow diagram depicting an example implementation of a method of printing and selective drying.

FIG. 4 is a flow diagram of implementation of a method printing and selective drying of a substrate during printing. In discussing FIG. 4, reference may be made to the components depicted in FIGS. 1 and 2. Such reference is made to provide contextual examples and not to limit the manner in which the method depicted by FIG. 4 may be implemented. A print job is received. The print job includes an image to be printed upon a substrate utilizing printheads (block 402). Referring back to FIGS. 1 and 2, job receipt 108 (FIG. 1) or job receipt module 208 (FIG. 2), when executed by processing resource 240, may be responsible for implementing block 402.

The print job is analyzed to determine a set of imaged segments of the print job, a set of image-adjacent segments of the print job, and a set of remote segments of the print job (block 404). Referring back to FIGS. 1 and 2, job analysis engine 110 (FIG. 1) or job analysis module 210 (FIG. 2), when executed by processing resource 240, may be responsible for implementing block 404.

The print job is printed utilizing a first set of printheads (block 406). Referring back to FIGS. 1 and 2, job print engine 112 (FIG. 1) or job print module 212 (FIG. 2), when executed by processing resource 240, may be responsible for implementing block 406.

A cooling liquid is applied to the set of image-adjacent segments of the printed print job utilizing a second set of printheads downstream from the first set of printheads (block 408). Referring back to FIGS. 1 and 2, cooling liquid application engine 114 (FIG. 1) or cooling liquid application module 214 (FIG. 2), when executed by processing resource 240, may be responsible for implementing block 408.

The printed print job is exposed to an array of controllable illumination element. The array of illumination elements is controlled to apply a drying illumination to the imaged segments and the image-adjacent segments of the printed print job, without providing the drying illumination to the remote segments (block 410). Referring back to FIGS. 1 and 2, illumination control engine 116 (FIG. 1) or illumination control module 216 (FIG. 2), when executed by processing resource 240, may be responsible for implementing block 410.

FIGS. 1-4 aid in depicting the architecture, functionality, and operation of various examples. In particular, FIGS. 1-3 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function(s). Examples can be realized in a memory resource for use by or in connection with a processing resource. A "processing resource" is an instruction execution system such as a computer/processor-based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 4 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A method for printing and selective drying of a substrate, comprising:

receiving a print job that includes an image to be printed upon a substrate utilizing printheads;

analyzing the print job to determine a set of imaged segments of the print job;

a set of image-adjacent segments of the print job;

a set of remote segments of the print job;

printing the print job upon the substrate utilizing a first set of printheads;

applying a cooling liquid to the set of image-adjacent segments of the printed print job utilizing a second set of printheads downstream from the first set of printheads;

exposing the printed print job to an array of controllable illumination elements; and controlling the array of illumination elements to apply a drying illumination to the imaged segments and the image-adjacent segments of the printed print job, without providing the drying illumination to the remote segments, wherein the imaged segments and the image-adjacent segments are located in a position of the substrate that is less than a width of the substrate, the remote segments lying between an edge of the substrate and the image-adjacent segments.

2. The method of claim 1, wherein the substrate is a textile substrate.

3. The method of claim 1, wherein for each imaged segment ink is to be applied by the first set of printheads to a threshold liquid level to create the image, wherein each image-adjacent segment is not an imaged segment and has a distance from a nearest imaged segment that is less than a predetermined threshold distance, and wherein each remote segment of the print job is not an imaged segment and is not an image-adjacent segment.

4. The method of claim 1, further comprising correlating the determined imaged segments, image-adjacent segments, and remote segments of the print job with subdivisions of the array of controllable illumination elements.

5. The method of claim 1, wherein the array of illumination elements includes an array of LEDs and the drying illumination includes UV light between 356 nm and 395 nm.

6. The method of claim 1, wherein the array of illumination elements includes a first set of illumination elements that correlates with the imaged segments and the image-adjacent segments of the print job and a second set of elements that correlates with the remote segments of the print job, and further comprising activating the first set of elements to accomplish selective drying of the printed print job.

7. The method of claim 5, wherein the second set of elements are not activated for drying illumination of the printed print job.

8. The method of claim 1, wherein controlling the array of illumination elements to apply a drying illumination includes a determining an exposure time for each of the illumination elements that is to be utilized for drying the substrate, and controlling the drying illumination according to the determined exposure time.

9. The method of claim 1, further comprising analyzing the print job to determine an amount of cooling liquid to be applied to the image-adjacent segments based upon absorption properties of the substrate.

10. The method of claim 1, wherein ink is to be applied to the set of image-adjacent segments at a level below the threshold level to create the image.

11. The method of claim 1, wherein the cooling liquid is a liquid utilized in other printing operations at the printer.

12. The method of claim 1, wherein the cooling liquid is a transparent or substantially transparent cooling liquid from the group consisting of an ink, a primer, a fixer, an overcoat liquid, water, and a solvent other than water.

13. A system to selectively dry a substrate during a printing operation, comprising:

a substrate transfer device;

a cooling liquid application device;

an array of illumination elements;

a job receipt engine, to receive a print job including an image to be printed upon the substrate;

a job analysis engine, to analyze the print to job to determine a set of imaged segments of the print job, wherein for each imaged segment ink is to be applied to a threshold liquid level to create the image;

a set of image-adjacent segments of the print job, wherein each image-adjacent segment is not an imaged segment, and has a distance from a nearest imaged segment that is less than a predetermined threshold distance;

a set of remote segments of the print job that are not imaged segments or image-adjacent segments; an amount of cooling liquid to be applied to the image-adjacent segments;

a job print engine, to cause printing of the print job upon the substrate utilizing a first set of printheads;

a cooling liquid application engine, to control the cooling liquid application device to selectively apply the cooling liquid to the image-adjacent segments of a printed print job utilizing a second set of printheads;

an illumination control engine, to cause the substrate transfer device to move the substrate to be exposed to the array of controllable illumination elements, and to control the array of illumination elements to apply a drying illumination to the imaged segments and the image-adjacent segments of the printed print job, without providing the drying illumination to the remote segments, wherein the imaged segments and the image-adjacent segments are located in a position of the substrate that is less than a width of the substrate, the remote segments lying between an edge of the substrate and the image-adjacent segments.

14. The system of claim 13, wherein the illumination control engine is to correlate the determined imaged segments, image-adjacent segments, and remote segments of the print job with subdivisions of the array of controllable illumination elements;

determine an exposure time for each of the illumination elements that is to be utilized for drying the substrate; and control the drying illumination according to the determined exposure time.

15. An inkjet printer, comprising:

an image forming device with a first set printheads for forming an image upon a textile substrate;

a transfer device for moving the textile substrate;

a cooling liquid application device with a second set of printheads for selectively applying a cooling liquid;

an array of illumination elements;

a controller, to receive a print job including an image to be printed upon the textile substrate;

analyze the print to job to determine a set of imaged segments;

a set of image-adjacent segments;

a set of remote segments of the print job, wherein the remote segments are not imaged segments or image-adjacent segments; an amount of cooling liquid to be applied to the image-adjacent segments;

cause the first set of printheads to print the print job upon the textile substrate;

control the second set of printheads to selectively apply the cooling liquid to the image-adjacent segments of a printed print job; and cause the substrate transfer device to move the textile substrate to be exposed to the array of controllable illumination elements; and control the array of illumination elements to apply a drying illumination to the imaged segments and the image-adjacent segments of the printed print job, without providing the drying illumination to the remote segments, wherein the imaged segments and the image-adjacent segments are located in a position of the substrate that is less than a width of the substrate, the remote segments lying between an edge of the substrate and the image-adjacent segments.

16. The method of claim 1, wherein each of the image-adjacent segments has no ink or a level of ink below a predetermined level.

17. The method of claim 1, further comprising:

determining an amount of the cooling liquid to be applied to each of the image-adjacent segments based on an absorption property of the substrate.

18. The method of claim 1, further comprising:

storing information indicative of a plurality of absorption properties for a corresponding number of substrates; and determining the amount of the cooling liquid to be applied to each of the image-adjacent segments based on the stored information.

* * * * *